United States Patent [19]

Greig et al.

[11] Patent Number: 4,721,120

[45] Date of Patent: Jan. 26, 1988

[54] SMOKING ARTICLES

[75] Inventors: Colin C. Greig, Redlynch; Richard R. Baker, Southampton; Frederick J. Dashley, New Milton; Anthony D. McCormack, Crowborough, all of England

[73] Assignee: British-American Tobacco Company Limited, London, England

[21] Appl. No.: 908,340

[22] Filed: Sep. 17, 1986

Related U.S. Application Data

[63] Continuation-in-part of Ser. No. 606,360, May 2, 1984, Pat. No. 4,624,268.

[30] Foreign Application Priority Data

May 17, 1983 [GB] United Kingdom ..... 8313604

[51] Int. Cl.[4] ..... A24D 1/02

[52] U.S. Cl. ..... 131/365; 131/331; 131/334

[58] Field of Search ..... 131/334, 331, 332, 333, 131/365

[56] References Cited

U.S. PATENT DOCUMENTS

| | | | |
|---|---|---|---|
| 3,410,276 | 11/1968 | Armbrust, Jr. et al. | 131/334 |
| 3,744,496 | 7/1973 | McCarty | 131/365 |
| 4,231,377 | 11/1980 | Cline et al. | 131/365 |
| 4,407,308 | 10/1983 | Baker et al. | 131/365 |
| 4,420,002 | 12/1983 | Cline | 131/365 |
| 4,433,697 | 2/1984 | Cline et al. | 131/365 |
| 4,450,847 | 5/1984 | Owens | 131/365 |
| 4,461,311 | 7/1984 | Mathews et al. | 131/365 |

OTHER PUBLICATIONS

*The Condensed Chemical Dictionary,* 10th Edition, Van Nostrand Reinhold Comp. N.Y., N.Y., date: 4/1983.

*Primary Examiner*—V. Millin

*Attorney, Agent, or Firm*—Kane, Dalsimer, Sullivan, Kurucz, Levy, Eisele and Richard

[57] ABSTRACT

Smoking articles comprise a smoking material rod wrapped with a paper wrapper including aluminum hydroxide and an organic acid salt of a group I or II metal. The article exhibits at least 30% reductions in visible sidestream smoke when lit.

16 Claims, No Drawings

SMOKING ARTICLES

BACKGROUND OF THE INVENTION

Cross-Reference to Related Application

This application is a continuation-in-part of copending U.S. application Ser. No. 606,360 filed May 2, 1984 now U.S. Pat. No. 4,624,268.

Field of the Invention

This invention relates to wrapped smoking articles, particularly cigarettes.

Brief Description of the Prior Art Various proposals have been made for cigarettes which, when smoked, emit reduced amounts of sidestream-smoke constituents, sidestream smoke being the smoke which emanates from the lit end of the cigarette. Thus, for example, in United Kingdom Patent Specification No. 2,094,130A there is disclosed a cigarette of reduced sidestream emission which comprises a rod of smoking material wrapped in a cigarette paper of which the air permeability due to viscous flow is not more than about 3 CORESTA units and of which the ratio of the coefficient of diffusion of oxygen through nitrogen in the paper to the thickness of the paper is in the range of 0.08 to 0.65 cm sec $^{-1}$.

In the U.S. Pat. No. 4,231,377, it is proposed to reduce sidestream smoke by incorporating a combination of magnesium oxide and an adjuvant salt in cigarette paper.

Conventional cigarette paper comprises cellulose fibres and an inorganic filler, most commonly chalk. A burn-controlling compound is also often included.

SUMMARY OF THE INVENTION

The present invention provides a smoking article comprising a smoking-material rod enwrapped in a wrapper comprising aluminium hydroxide and/or lithium hydroxide with one or more organic acid salts of the Group I or II metals, so that the reduction in visible sidestream smoke emanating from said smoking article when lit is at least 30% of that from a comparable lit smoking article having a conventional wrapper and smoked under comparable conditions.

The inherent air permeability of the paper, i.e., that due to viscous flow, should be in a range of 3 to 45 CORESTA units but preferably within a range of 3 to 20 CORESTA units and more preferably within a range of 3 to 15 CORESTA units. The air permeability of a paper as expressed in CORESTA units is the amount of air in cubic centimetres which passes through one square centimetre of the paper in one minute at a constant pressure difference of 1.0 kilo-pascal. For details as to the concept of viscous flow in relation to cigarette-paper permeability, reference is made to the aforesaid Specification No. 2,094,130A.

Preferably, the cigarette paper comprises at least three of the above indicated compounds.

The present invention also provides smoking-article wrapper paper comprising aluminium hydroxide and/or lithium hydroxide with one or more organic acid salts of the Group I or II metals.

DETAILED DESCRIPTION OF THE PREFERRED EMBODIMENTS OF THE INVENTION

Organic acid salts of Group I or II metals suitable for use in accordance with the present invention may be selected from salts which are recognised in the art as being burn control additives when at a loading level of between 0.5 and 2.0%.

The compounds may be applied in aqueous solution to the cigarette paper. Alternatively, the compounds may be included in the paper at the paper-making stage. The compounds and loading level thereof are preferably selected so as to result in a reduction in visible sidestream smoke of at least about 40%.

The loading levels should be selected such that the basis weight of the paper is increased to greater than 25 g m$^{-2}$ and preferably greater than 30 g m$^{-2}$. The final weight of the paper could even be as high as about 40 g m$^{-2}$.

Some of the compounds which in accordance with the present invention bring about a reduction in visible sidestream smoke exhibit adverse properties if they are present at too high a loading level. Thus, for example, lithium hydroxide can cause a breakdown of the paper structure and therefore the loading level of this compound should be limited to a level below which this breakdown phenomenon does not occur. A loading level limit should also be observed for potassium formate, because higher loading levels have been found to result in an unacceptable, coke-like ash formation in the smoking of test cigarettes. An advantage of using a plurality, especially three or more, sidestream-smoke reducing compounds is that a requisite total loading level can be obtained without exceeding an upper loading level limit of any one of the compounds.

It was determined by smoking test cigarettes that only small reductions in visible sidestream smoke resulted from using cigarette papers each treated with a single compound, this being respectively magnesium oxide, calcium carbonate, lithium carbonate, potassium sodium tartrate, aluminium ammonium sulphate, magnesium citrate, magnesium oxalate, triammonium citrate, citric acid and heavy magnesium carbonate.

Examples of the invention will now be further described, by way of example, by reference to a number of experiments.

In the experiments, the cigarettes were analysed by observing the optical density of the visible sidestream smoke emanating from a lit cigarette being allowed to smoulder. Because of the deficiencies experienced in such subjective analyses using human observers, an instrument was used which is capable of monitoring a column of sidestream smoke passing between a light source of controlled intensity and a photodiode having a spectoral sensitivity similar to that of the human eye. The signal derived from the photodiode was recorded and converted by simple calculation to a mean optical density value.

EXPERIMENT 1

Filter tipped cigarettes were made having a 64 mm tobacco rod of flue-cured tobacco and a 20 mm cellulose acetate filter. Aluminium hydroxide was applied at a loading level of 7.0 g m$^{-2}$(24%) to a single layer nonperforated wrapper of cigarette paper having natural air permeability to produce a paper with a final permeability of 13 CORESTA Units (C.U.) and a weight of 29 g $m^{-2}$. The percentage figures are the loading levels of the respective compounds based on the weight of the final paper. The mean optical density value of the sidestream smoke was $11.23\times10^{-3}$. A control cigarette with conventional cigarette paper wrapper was prepared having the following characteristics; a final permeability of 45 C.U., weight 23 g $m^{-2}$ and 1% tri-potassium citrate additive. The optical density value of this cigarette when lit was $15.25\times10^{-3}$. When compared with the cigarette of Experiment 1, the latter gave a reduction in visible sidestream optical density of 26%.

EXPERIMENT 2

The procedure of Experiment 1 was followed except the cigarette paper comprises aluminium hydroxide at 7.0 g $m^{-2}$(23%) and sodium formate at 2 g $m^{-2}$(6.5%). The air permeability was 13 C.U. and the weight was 31 g $m^{-2}$. The mean optical density value of the sidestream smoke was $8.75\ 5\times10^{-3}$, the total reduction in visible sidestream smoke being 43%.

EXPERIMENT 3

The procedure of Experiment 1 was followed except the cigarette paper comprised aluminium hydroxide at 7.0 g $m^{-2}$(23%) and sodium acetate at 2 g $m^{-2}$(6.5%). The air permeability was 13 C.U. and the weight was 31 g $m^{-2}$. The mean optical density value of the sidestream smoke was $9.41\times10^{-3}$, the total reduction in visible sidestream smoke being 38%.

EXPERIMENT 4

The procedure of Experiment 1 was followed except the cigarette paper comprised aluminium hydroxide at 7.0 g $m^{-2}$(23%) and sodium formate at 1 g $m^{-2}$(3.2%) and sodium acetate at 1 g $m^{-2}$(3.2%). The air permeability was 13 C.U. and the weight was 31 g $m^{-2}$. The mean optical density value of the sidestream smoke was $9.00\times10^{-3}$, the total reduction in visible sidestream smoke being 41%.

EXPERIMENT 5

The procedure of Experiment 1 was followed except the cigarette paper comprised aluminium hydroxide at 7.0 g $m^{-2}$(23%) and sodium tartrate at 2 g $m^{-2}$(6.5%). The air permeability was 13 C.U. and the weight was 31 g $m^{-2}$. The mean optical density value of the sidestream smoke was $10.93\times10^{-3}$, the total reduction in visible sidestream smoke being 28%. This value can be readily increased by either starting with a lower paper permeability and/or higher basis weight paper.

EXPERIMENT 6

The procedure of Experiment 1 was followed except the cigarette paper comprised aluminium hydroxide at 7.0 g $m^{-2}$(23%) and sodium lactate at 2 g $m^{-2}$(6.5%). The air permeability was 13 C.U. and the weight was 31 g $m^{-2}$. The mean optical density value of the sidestream smoke was $9.79\times10^{-3}$, the total reduction in visible sidestream smoke being 36%.

EXPERIMENT 7

The procedure of Experiment 1 was followed except the cigarette paper comprised aluminium hydroxide at 7.0 g $m^{-2}$(23%) and lithium tartrate at g $m^{-2}$(6.5%). The air permeability was 13 C.U. and the weight was 31 g $m^{-2}$. The mean optical density value of the sidestream smoke was $10.23\times10^{-3}$, the total reduction in visible sidestream smoke being 33%.

EXPERIMENT 8

The procedure of Experiment 1 was followed except that the paper used was of a sort suitable for self-extinguishing cigarettes. Therefore, the cigarette required to be puffed by attachment to a standard smoking machine having smoking conditions of 35 $cm^3$ puff of 2 second duration and 1 puff a minute. The cigarette paper contained aluminium hydroxide at 7.0 g $m^{-2}$(21%) and lithium hydroxide at 3 g $m^{-2}$(8.8%) and sodium acetate at 1 g $m^{-2}$(2.9%) and sodium tartrate at 1 g $m^{-2}$(2.9%). The air permeability was 4 C.U. and the weight was 34 g $m^{-2}$. The mean optical density value of the sidestream smoke was $4.29\times10^{-3}$, the total reduction in visible sidestream smoke being 72%.

EXPERIMENT 9

The procedure of Experiment 1 was followed except that the paper used was of a sort suitable for selfextinguishing cigarettes. Therefore, the cigarette required to be puffed by attachment to a standard smoking machine having smoking conditions of 35 $cm^3$ puff of 2 second duration and 1 puff a minute. The cigarette paper contained lithium hydroxide at 3.0 g $m^{-2}$(9.4%) and sodium lactate at 2 g $m^{-2}$(6.3%). The air permeability was 4 C.U. and the weight was 32 g $m^{-2}$. The mean optical density value of the sidestream smoke was $2.70\times10^{-3}$, the total reduction in visible sidestream smoke being 82%.

EXPERIMENT 10

The procedure of Experiment 1 was followed except the cigarette paper comprised aluminium hydroxide at 7.0 g $m^{-2}$(22%) and magnesium citrate at 1.5 g $m^{-2}$(4.7%) and citric acid at 1.5 g $m^{-2}$(4.7%). The air permeability was 13 C.U. and the weight was 32 g $m^{-2}$. The mean optical density value of the sidestream smoke was $10.65\times10^{-3}$, the total reduction in visible sidestream smoke being 30%.

EXPERIMENT 11

The procedure of Experiment 1 was followed except the cigarette paper comprised aluminum hydroxide at 7.0 g $m^{-2}$(23%) and calcium acetate at 2 g $m^{-2}$(6.5%). The air permeability was 13 C.U. and the weight was 31 g $m^{-2}$. The mean optical density value of the sidestream smoke was $10.42\times10^{-3}$, the total reduction in visible sidestream smoke being 32%.

What is claimed is:

1. A smoking article comprising a smoking material rod enwrapped in a paper wrapper, said wrapper including aluminium hydroxide and at least one organic acid salt of the group I & II metals, so that the reduction in visible sidestream smoke emanating from said smoking article when lit is at least 30% of that from a comparable lit smoking article having a conventional wrapper and smoked under comparable conditions.

2. A smoking article according to claim 1 wherein the wrapper further comprises lithium hydroxide.

3. A smoking article comprising a smoking material rod enwrapped in a paper wrapper, said wrapper including lithium hydroxide and at least one organic acid salt of the group I or II metals, so that the reduction in visible sidestream smoke emanating from said smoking article when lit is at least 30% of that from a comparable lit smoking article having a conventional wrapper and smoked under comparable conditions.

4. A smoking article according to claim 3 wherein the wrapper further comprises aluminium hydroxide.

5. A smoking article according to claim 1, wherein the air permeability of the wrapper is in the range of 3 to 45 CORESTA units.

6. A smoking article according to claim 1 wherein the air permeability of the wrapper is in the range of 3 to 20 CORESTA units.

7. A smoking article according to claim 1 wherein the air permeability of the wrapper is in the range of 3 to 15 CORESTA units.

8. A smoking article according to claims 1, 2 or 3 wherein the wrapper further includes at least one additional organic acid salt of the group I and II metals.

9. A smoking article paper wrapper comprising aluminium hydroxide and at least one organic acid salt of the group I or II metals, so that the reduction in visible sidestream smoke emanating from said smoking article when lit is at least 30% of that from a comparable lit smoking article having a conventional wrapper and smoked under comparable conditions.

10. A smoking article paper wrapper according to claim 9 wherein the wrapper further comprises lithium hydroxide.

11. A smoking article paper wrapper comprising lithium hydroxide and at least one organic acid salt of the group I and II metals, so that the reduction in visible sidestream smoke emanating from said smoking article when lit is at least 30% of that from a comparable lit smoking article having a conventional wrapper and smoked under comparable conditions.

12. A smoking article according to claim 11 wherein the wrapper further comprises aluminium hydroxide.

13. A smoking article paper wrapper according to claim 9, having an air permeability in the range of 3 to 45 CORESTA units.

14. A smoking article paper wrapper according to claim 9, having an air permeability in the range of 3–20 CORESTA units.

15. A smoking article paper wrapper according to claim 9, having an air permeability in the range of 3–15 CORESTA units.

16. A smoking article paper wrapper according to claims 9, 10 or 11 including at least one additional organic acid salt of the group I and II metals.

* * * * *

UNITED STATES PATENT AND TRADEMARK OFFICE

CERTIFICATE OF CORRECTION

PATENT NO. : 4,721,120

DATED : January 26, 1988

INVENTOR(S) : Colin C. Greig et al

It is certified that error appears in the above—identified patent and that said Letters Patent is hereby corrected as shown below:

Column 3, line 66; - "at g $m^{-2}$(6.5%)." should read

-- 2 g $m^{-2}$(6.5%). --

Signed and Sealed this

Nineteenth Day of July, 1988

*Attest:*

*Attesting Officer*

DONALD J. QUIGG

*Commissioner of Patents and Trademarks*